US005720925A

United States Patent [19]

Oehme

[11] Patent Number: 5,720,925

[45] Date of Patent: Feb. 24, 1998

[54] FLASK

[75] Inventor: Michael Oehme, Basel, Switzerland

[73] Assignee: Promochem GmbH Handelsgesellschaft fur Chemische Produkte, Wesel, Germany

[21] Appl. No.: 892,180

[22] Filed: Jul. 14, 1997

Related U.S. Application Data

[63] Continuation of Ser. No. 567,318, Dec. 5, 1995, abandoned.

[30] Foreign Application Priority Data

Dec. 6, 1994 [DE] Germany ..... 44 43 340.9

[51] Int. Cl.[6] ..... B01L 3/00

[52] U.S. Cl. ..... 422/102; 422/100; 422/101; 422/104; 215/335; 220/366.1; 220/367.1

[58] Field of Search ..... 422/72, 100, 101, 422/102, 104; 215/335; 220/366.1, 367.1

[56] References Cited

U.S. PATENT DOCUMENTS

| | | | |
|---|---|---|---|
| 4,070,249 | 1/1978 | Janin et al. | 422/102 X |
| 4,073,693 | 2/1978 | Janin | 422/102 X |
| 4,335,074 | 6/1982 | Bernas | 422/102 |
| 4,364,903 | 12/1982 | Bittings | 422/101 |
| 4,559,837 | 12/1985 | Cerqueira | 422/102 X |
| 5,015,445 | 5/1991 | Doleman et al. | 422/204 |
| 5,038,958 | 8/1991 | Dreier | 220/366 |

*Primary Examiner*—Harold Y. Pyon

*Attorney, Agent, or Firm*—Merchant, Gould, Smith, Edell, Welter & Schmidt, P.A.

[57] ABSTRACT

A flask for standard solutions comprises a flask body and a closure cap for sealingly closing the flask body. It has in an upper part of the flask body a capillary passage communicating with a chamber for containing the solution. The flask is filled and/or emptied through the capillary passage. The capillary passage acts as a recondensation zone and reduces evaporative escape of solvents upon removal of the liquid, even when the closure cap is closed. The risk of contamination of the solution in the flask is also reduced. The narrow opening of the capillary passage can be sealingly closed with the closure cap of the flask. After the closure cap is removed the solution can be easily completely removed through the capillary passage using a syringe, without having to tilt the flask.

12 Claims, 2 Drawing Sheets

FLASK

This is a Continuation of application Ser. No. 08/567,318, filed Dec. 5,1995, now abandoned.

FIELD OF THE INVENTION

The invention concerns a flask comprising a flask body and a closure cap for sealingly closing the flask body. Such a flask is suitable and intended in particular for standard solutions which are used in analytical chemistry.

BACKGROUND OF THE INVENTION

Standard solutions for analytical chemistry are stored in closed flasks or ampoules. A disadvantage is that the known closure caps for the glass flasks which are commonly of plastics material, generally lose sealing integrity when used over prolonged periods of time. In addition, when the flasks containing the standard solutions are stored in a freezer the closure caps can easily come loose as a result of the different coefficients of expansion of glass and plastics material. The problem of contamination of the solutions due to the seal of the closure cap also arises.

Even ampoules in which standard solutions are stored and which are fused closed can suffer from a loss of sealing integrity. There is then the danger that the solvents contained in standard solutions evaporate. That in turn gives rise to wrong results in analysis by means of standard solutions.

Finally, when sealingly closed flasks or ampoules are opened, solvents which are contained therein and which have already evaporated may also escape, and that also gives rise to incorrect analysis results.

The invention aims to provide a closable flask, in particular for standard solutions, which can be universally employed and which protects solutions contained therein from evaporation losses and contamination, prior to and also upon removal.

SUMMARY OF THE INVENTION

According to the present invention, in a flask comprising a flask body and a closure cap for sealingly closing the flask body, the flask body comprises an upper and a lower part, the lower part having means defining an internal space for containing a solution, and the upper part having a capillary passage in communication with the internal space, the flask body being filled and/or emptied through the capillary passage.

The capillary passage in the upper pan acts as a recondensation zone and reduces the evaporative escape of solvent, even when the closure cap is removed from the flask. In addition, because of the fine, elongated constriction of the capillary passage there is a reduced risk of contamination of the solution by the material of the seal of the closure cap. The narrow opening of the capillary passage cannot be closed by the closure cap. After removal of the closure cap the solvent can be easily removed through the capillary passage, using suitable aids.

The capillary passage is in one embodiment provided in a substantially cylindrical insert portion which is disposed in the cylindrical upper part of the flask body, that is to say in the region of the flask neck, with an annular gap being defined between the external surface of the cylindrical insert portion and the internal wall of the cylindrical upper part. The annular gap between the body and the cylindrical insert portion ensures that, upon removal of the solution from the flask, any overflowing liquid cannot come into contact with the outer edge or the outside wall of the flask body.

The insert portion is desirably integral with the flask body, so that no leaks whatsoever can occur between the wall of the tubular body and the insert portion containing the capillary passage.

Preferably the upper end of the cylindrical upper part is provided with an external screwthread for screwing on the closure cap which has a corresponding internal screwthread.

In order to increase the contact pressure against the seal which is fitted into the closure cap the upper end of the cylindrical insert may project beyond the upper edge of the cylindrical upper part. When the closure cap is screwed on, the upper end of the cylindrical insert portion then presses into a seal which is fitted into the closure cap so that the opening of the capillary passage is sealingly closed. The contact pressure of the seal is so great that, when the flask is stored in a freezer, the closure cap cannot come loose or become perceptibly slack and the flask cannot therefore suffer a loss of sealing integrity.

In a practical embodiment of the invention, when the closure cap was unscrewed, the flask allowed only a few μm of for example hexane to evaporate and escape in a period of from 5 to 10 minutes. When the flask was closed the loss was only 2 to 6 mg over a period of 6 months. In that respect the amount of liquid contained in the flask was 600 to 1000 mg.

In another embodiment the flask body is a substantially cylindrical body closed at its lower end, with the capillary passage extending through the upper pan of the cylindrical body, which can be solid. In order to provide a sealed closure the capillary passage advantageously opens into a projection provided at an upper end of the flask body. When the closure cap is screwed on the projection presses into the seal of the closure cap whereby the contact pressure and therewith the sealing effect are increased.

The bottom of the flask body is advantageously of a V-shaped configuration. Residues of the contained liquid collect in the V-shaped depression so that the flask can be completely emptied by means of a syringe or the like which is suitable for chromatography.

So that the closure cap does not project radially beyond the flask body the upper part of the flask body can be reduced in size in a tapered or stepped configuration.

The flask body is preferably a glass body. It can however also be made from plastics material which is resistant to solutions such as standard solutions.

BRIEF DESCRIPTION OF THE DRAWINGS

Three embodiments of the flask according to the invention are described hereinafter with reference to the drawings in which.

DESCRIPTION OF THE PREFERRED EMBODIMENTS

Figure 1:
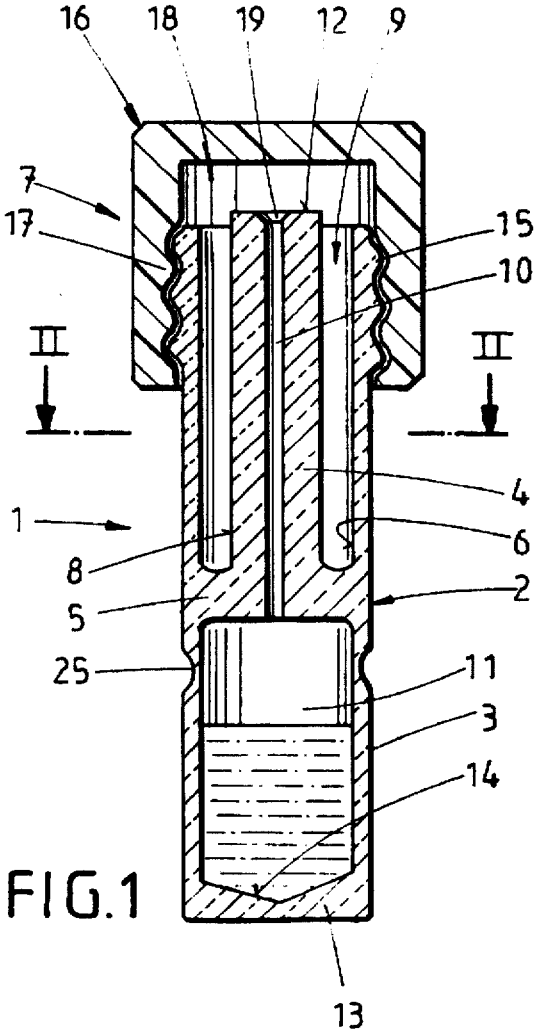
FIG. 1 is a view in longitudinal section of a first embodiment of the flask.

FIG. 1 is a sectional view of a flask adapted to contain standard solutions for analytical chemistry. The flask comprises a flask body 1 and a closure cap 16 which sealingly closes the flask body.

The flask body 1 has a cylindrical glass body 2 which is closed at its lower end, and has a substantially smooth outside wall 3. A lower part of the glass body 2 has an internal space 11 for containing the solution. An upper part of the glass body 2 accommodates a substantially cylindrical insert portion 4 which is integral with the tubular glass body 2. At its lower end the insert portion 4 has a peripherally extending web portion 5 which is formed on the wall 6 of the tubular glass body 2.

The outside diameter of the cylindrical insert portion 4 is smaller than the inside diameter of the glass body 2 so that there is an annular gap 9 in the region of the flask neck 7 between a peripheral surface 8 of the insert portion 4 and a wall 6 of the glass body 2.

The insert portion 4 includes a capillary passage 10, which extends longitudinally and which communicates with the internal space 11 in the flask body. An upper end 12 of the cylindrical insert portion 4 projects beyond the upper edge of the flask body 1. The upper end of the capillary passage 10 has an enlarged opening 19 of funnel-like shape.

The bottom 13 of the internal space 11 is of a V-shaped configuration. Liquid residues can collect in the V-shaped depression 14 so that, without having to be tipped, the flask can be completely emptied from above by means of pipette or a chromatography syringe.

At its upper end the flask body 1 is provided with an external screwthread 15 for screwing on the closure cap 16. The closure cap 16, of plastics material, has a corresponding internal screwthread 17 and includes a seal 18 which fits into a cylindrical recess in the closure cap 16. When the closure cap 16 is screwed on, the upper end 12 of the cylindrical insert portion 4, which projects a short distance above the edge of the flask, presses into the seal 18 of the closure cap 16 so that opening 19, is sealingly closed. The closure cap 16 further bears against the upper edge of the flask body 1.

By virtue of the constriction formed in the flask neck 7 by the capillary passage 10, evaporation loss from the internal space 11 in the flask body 1 is at a minimum. Measurements have shown that, even when the closure cap 16 is unscrewed, only a few μg of evaporated hexane escapes over a period of from 5 to 10 minutes. In the closed condition of the flask the evaporation loss is only 2 to 5 mg over a period of 6 months when the total amount of liquid contained in the flask is from 600 to 100 mg.

Figure 3:
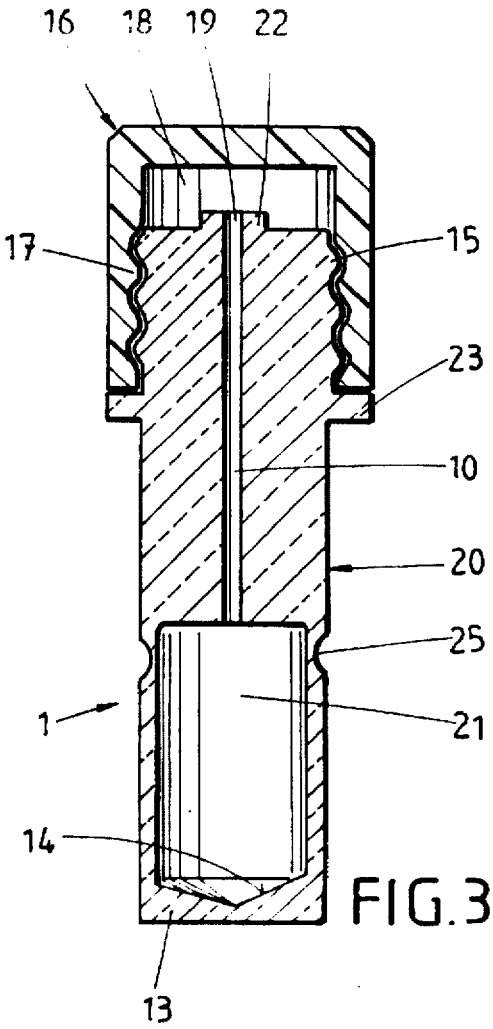
FIG. 3 is a longitudinal section of a second embodiment of the flask.
Figure 2:
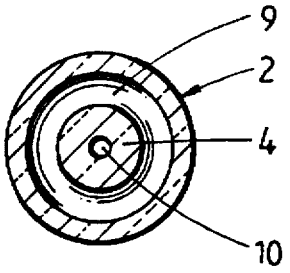
FIG. 2 is a view of the flask in FIG. 1 in cross-section taken along line II—II in FIG. 1.

FIG. 3 shows a further embodiment of the flask according to the invention. This embodiment differs from the embodiment described with reference to FIGS. 1 and 2 essentially in that the upper part of the flask body 1 is solid. The flask body I is a substantially cylindrical body 20 which in its lower part contains a chamber or internal space 21 for accommodating the standard solution or some other liquid. The capillary passage 10 extends through the upper part and is in fluid communication with the chamber 21. The upper end of the capillary passage 10 opens in a projection 22 at the top end of the cylindrical body 20. The projection 22 presses into the seal 18 of the closure cap 16 when the closure cap 16 is screwed on.

Below the external screwthread 15 the flask body 1 also has a peripherally extending collar 23 forming an abutment for the closure cap 16. In a modification (not shown) the flask neck 7 in the region of the external screwthread 15 is of a smaller diameter than the remaining part of the flask body 1 so that the closure cap 16 does not project radially beyond the flask neck 7. It must then be ensured that the necessary stability in the region of the flask neck 7 is guaranteed.

When larger amounts of liquid are involved the chamber 21 can be appropriately enlarged, and the diameter or the length of the flask body is of suitable dimensions for that purpose. In principle the flask body can be of any shape, but the capillary passage 10 should have a given minimum length and a given maximum diameter.

Even if the flask body 1 is increased in size, there is an only low level of risk of evaporation and escape and contamination of the liquid contained in the flask, by virtue of the capillary constriction in the neck region of the flask neck 7.

In the embodiments of FIGS. 1 and 3 the flask body 1 has a reduction or neck portion 25 which is caused by the production process and which in the embodiments of FIGS. 1 and 3 is disposed in the region of the chamber 11, 21 although the volume of the chamber 11, 21 is not reduced, or at any rate not perceptibly so, by the neck portion 25.

Figure 4:
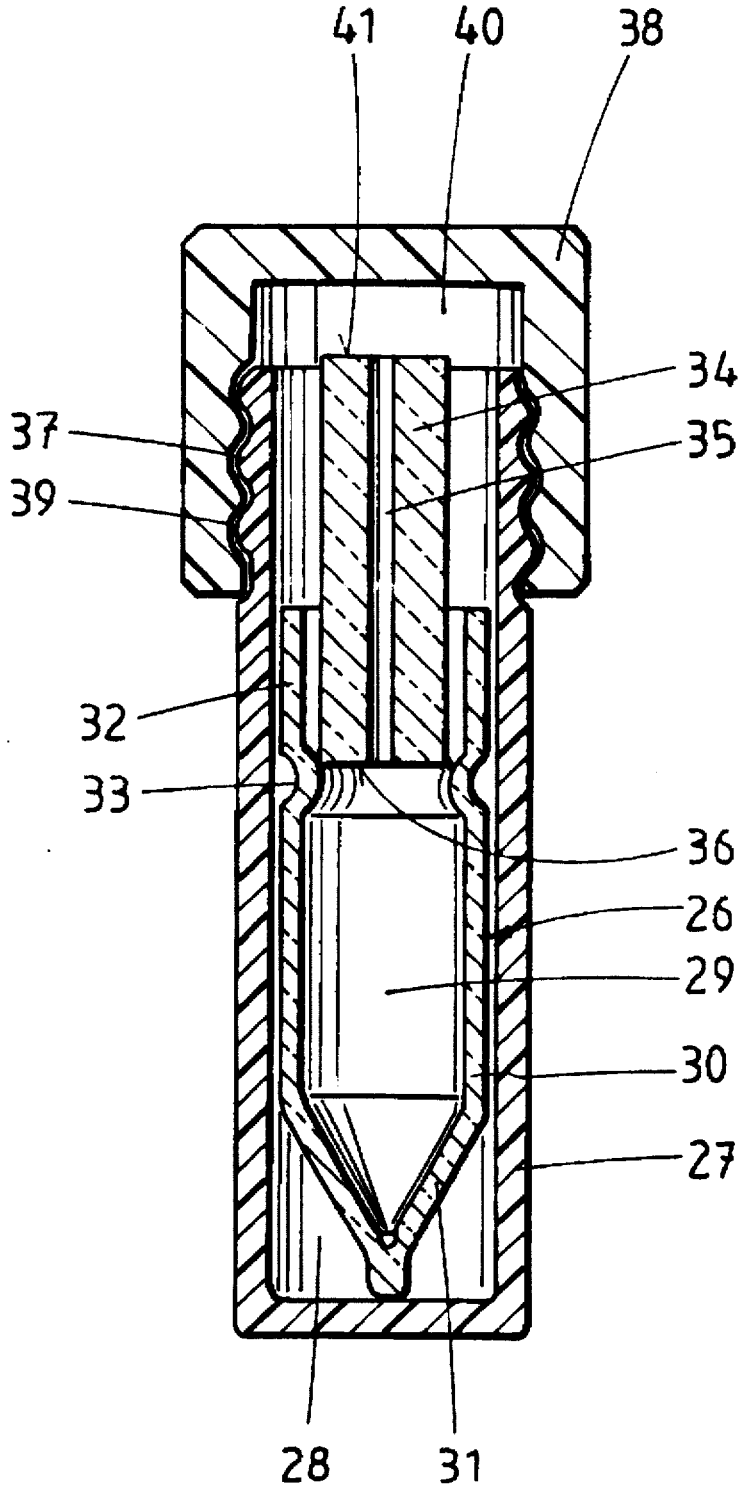
FIG. 4 is a longitudinal section of a third embodiment of the flask.

A third embodiment of the flask for standard solutions, in accordance with the invention, is shown in FIG. 4. The flask body 26, as in the embodiments of FIGS. 1 to 3, comprises transparent glass, and is arranged in a cylindrical casing 27 which serves as external packaging and which comprises transparent or opaque plastics material. The flask body is fitted into an internal space 28 of the casing 27 loosely but with a close fit in order on the one hand to facilitate assembly and on the other hand to be able to replace the flask body 26 if this seems necessary for any reason. Therefore different effects in terms of expansion and shrinkage of the various materials, caused by temperature, can also be compensated.

In FIG. 4 the flask body 26 is composed of two pans and has a main body 30 containing a chamber 29 for containing the standard solutions and having a conically tapering lower end 31, and an upper part comprising a neck 32 which is integrally connected to the main body 30 by way of a restricted portion 33.

A second part of the flask body 26 is fitted into the neck 33 and comprises a cylindrical insert portion 34 with a capillary passage 35 provided therein, which lies with its lower end 36 on the inside of the restricted portion 33 and which is durably connected thereto in sealed relationship, for example by being fused thereto, as both the main body 30 of the flask body 26 and also the insert portion thereof comprise the same material, preferably glass.

The cylindrical casing 27 or the housing for the flask shown in FIG. 4 is provided at the upper end with an external screwthread 37 onto which can be screwed a closure cap 38 which has a suitable internal screwthread 39. The closure cap 38 has a seal insert 40 which, in the closed position of the closure cap, bears sealingly against the outer end 41 of the insert portion 34 of the flask body 26.

The closure cap 38 also preferably comprises opaque plastics material so that the flask body 26 can be disposed in sealingly encapsulated relationship, and protected from the light, within the housing comprising the casing 27 and the closure cap 38 which is screwed thereon.

The embodiment of the flask according to the invention as shown in FIG. 4 has the advantage that the standard solution or other liquid in the flask body can be protected from light. This embodiment of the flask can also be produced at lower cost than the embodiments of FIGS. 1 to 3 because the individual parts of the flask body and the individual parts of the casing and the closure cap can be produced using simple moulds before they are connected together.

What is claimed is:

1. A storage flask for storing of standard solutions in a solvent, said flask comprising:

a flask body and a closure cap for sealingly closing said flask body, said flask body comprising an upper part and a lower part, said lower part having means defining a single internal space for containing a solution, and said upper part having a capillary passage in communication with said internal space, said flask body being filled and/or emptied through said capillary passage, said capillary passage sized to reduce evaporative escape of solvent from said internal space, said upper part integrally joined to said lower part;

wherein said flask body is substantially cylindrical and closed at its lower end, and said upper part includes a substantially cylindrical insert portion, and defining an annular gap between on external surface of said insert portion and an internal wall of said upper part, said capillary passage being provided in said insert portion, said annular gap extending longitudinally from an upper end toward said lower end of said flask body without communication with said single internal space.

2. A flask as claimed in claim 1, wherein said cylindrical insert portion is integral with said flask body.

3. A flask as claimed in claim 1, wherein an upper end of said cylindrical insert portion projects beyond an upper edge of said cylindrical upper part.

4. A flask as claimed in claim 1, wherein said closure cap is provided with a seal.

5. A flask as claimed in claim 1, wherein the bottom of said flask body has a V-shaped depression forming the lower end of said internal spaces.

6. A flask as claimed in claim 1, wherein said flask body and said insert portion are integral formed of glass.

7. A flask as claimed in claim 1, wherein said capillary passage is of a minimum length which is equal to or greater than the height of the internal space.

8. A flask as claimed in claim 1, wherein said flask body interchangeably fits into a casing onto which the closure cap is screwed.

9. A flask as claimed in claim 1 wherein said flask body is a substantially cylindrical body closed at its lower end, and said capillary passage extends through said upper part of said cylindrical body.

10. A flask as claimed in claim 9, wherein said capillary passage opens into a projection at an upper end of said cylindrical body.

11. A flask as claimed in claim 1, wherein an upper end of said flask body is provided with an external screwthread for screwing on said closure cap.

12. A flask as claimed in claim 11, wherein said upper part of said flask body is of a reduced outside diameter in the region of said external screwthread.

* * * * *